US007007319B2

(12) United States Patent
Dunnett et al.

(10) Patent No.: US 7,007,319 B2
(45) Date of Patent: Mar. 7, 2006

(54) OVERFLOW DEVICE FOR BATHTUB

(75) Inventors: Andrew Peter Dunnett, Goodworth Clatford Cottage, Goodworth Clatford, Andover, Hampshire (GB) SP11 7RN; Richard Thom, London (GB)

(73) Assignee: Andrew Peter Dunnett, Andover (GB)

( * ) Notice: Subject to any disclaimer, the term of this patent is extended or adjusted under 35 U.S.C. 154(b) by 0 days.

(21) Appl. No.: 10/956,968

(22) Filed: Oct. 2, 2004

(65) Prior Publication Data

US 2005/0071918 A1 Apr. 7, 2005

(30) Foreign Application Priority Data

Oct. 3, 2003 (GB) ..... 0323135

(51) Int. Cl.
*E03C 1/22* (2006.01)

(52) U.S. Cl. ..... 4/680; 4/668; 4/669; 4/683; 4/694; 137/410; 137/428

(58) Field of Classification Search ..... 4/668, 4/669, 508, 680, 683, 694; 137/428, 410

See application file for complete search history.

(56) References Cited

U.S. PATENT DOCUMENTS 4,945,579 A * 8/1990 Husting ..... 4/688

FOREIGN PATENT DOCUMENTS

| | | |
|---|---|---|
| DE | 589121 C | 12/1933 |
| FR | 824881 | 2/1938 |
| GB | 2288330 A | 10/1995 |
| GB | 2312838 A | 11/1997 |
| GB | 2375296 A | 11/2002 |
| JP | 55-042982 | 3/1980 |
| WO | WO93/09303 A1 | 5/1993 |
| WO | WO99/11876 A1 | 3/1999 |

* cited by examiner

*Primary Examiner*—Khoa D. Huynh
(74) *Attorney, Agent, or Firm*—John V. Stewart

(57) ABSTRACT

An overflow device for a bathtub with an overflow inlet arranged for mounting in a conventional overflow hole of the bathtub and a valve connected between a water supply and a conventional bath tap. A spring can be used to change the valve from its open state to its closed state. A float and trigger lever can detect water that has entered the overflow inlet and trigger the device to change, using the stored spring energy, from a set state in which the valve is open to a triggered state in which the valve is closed. A manually operable resetting element can be operated by a user to replenish the spring with energy and return the device to the set state. The device can be permanently plumbed in and the bulk of the device can be hidden from view outside the bathtub.

7 Claims, 4 Drawing Sheets

OVERFLOW DEVICE FOR BATHTUB

CROSS-REFERENCE TO RELATED APPLICATIONS

This application claims the priority benefit of UK patent application GB0323135.4 filed 03 Oct. 2003.

BACKGROUND TO THE INVENTION

1. Field of the Invention

This invention relates to an overflow device for a bathtub.

2. Description of the Prior Art

Conventionally, bathtubs are provided with an overflow hole at a level near the top of the bathtub, and the overflow hole is connected to the waste pipe leading from the bathtub. Accordingly, once the level of water reaches the overflow hole, the excess water can drain away to reduce the risk that water will spill over the upper edge of the bathtub and cause a mess and possible damage. Nevertheless, in some cases the overflow cannot cope with the rate of flow required to prevent spillage, for example if the pressure of the water supply to the taps is very high, or if the overflow passageway has become partly or completely blocked. Furthermore, preventing a bathtub from overflowing by draining away the excess water is wasteful of water.

There have been various proposals to deal with these problems. For example, systems are known for automatically opening the normal plug of the bathtub when the water level reaches a predetermined level, but such systems still result in wasted water. Also, electrical systems are known for automatically turning off the supply of water to the bathtub when the water level reaches a predetermined level, but such systems require a supply of electricity and a great amount of care in design and installation to prevent any risk of electrical shock. Furthermore, mechanical systems are known for automatically turning off the supply of water to the bathtub when the water level reaches a predetermined level, but such systems suffer variously from the problems of: bulkiness (see WO099/11876); that they would be difficult to reset when applied to a bathtub (see GB2312838); that reliance is made purely on the buoyancy of a float to provide the motive force to close off the water supply valve(s) (see GB2288330); that they need to be reset by a mechanism that it may be difficult to make accessible in a bathroom scenario (see WO93/09303); or that they are mounted inside the bathtub and need to be connected to the outlet of a conventional bath tap (see JP55042982). The present invention, or at least specific embodiments of it, addresses these problems.

SUMMARY OF THE INVENTION

In accordance with a first aspect of the present invention, there is provided an overflow device for a bathtub having a bath tap and an overflow hole, the device having: an overflow inlet arranged for mounting in the overflow hole; an overflow outlet communicating with the overflow inlet and for connection to a waste; a water inlet for connection to a water supply; a water outlet for connection to the bath tap; a valve connected between the water inlet and water outlet and having a closed state and an open state; means (such as a spring) for storing energy that can be used to change the valve from the open state to the closed state; means for detecting water that has entered the overflow inlet and for triggering the device to change, using energy stored by the energy storing means, from a set state in which the valve is open to a triggered state in which the valve is closed; and a manually operable resetting element that can be operated by a user to replenish the energy storing means with energy and to return the device to the set state. Because the device is arranged to be connected between the water supply and a conventional bath tap, it can be permanently plumbed in and the bulk of the device can be hidden from view outside the bathtub, for example behind a conventional bath panel. Because the device has an energy storing means that can be replenished with energy upon manual operation by the user, rather than relying, for example, purely on the buoyancy of a float to close a valve, the device can be of small size and yet have sufficient energy stored to close the valve reliably.

Preferably, the resetting element has a portion that projects, or is accessible, through the overflow inlet. Therefore there is no need to provide a hole through the bathtub or a bath panel, other than the conventional overflow hole in order to provide access to the resetting element.

Preferably, the water-detecting/triggering means comprises a float and a lever acting between the float and a detent arrangement for holding the resetting element in the set state, the lever having a velocity ratio of greater than unity. Such a velocity ratio enables any friction in the detent arrangement to be overcome more reliably.

Preferably, the device has a second such water inlet for connection to a water supply, a second such water outlet for connection to the, or another, bath tap, and a second such valve connected between the second water inlet and second water outlet and having a closed state and an open state, and the water-detecting/triggering means, energy storing means and resetting means are arranged also to operate the second valve. Accordingly, both a hot water supply and a cold water supply to the bathtub can be closed off when the bath begins to overflow.

Preferably, the energy storing means comprises a respective spring for each valve. This enables the stored energy to be more directly applied to each valve than if a single spring were used operating through some mechanism that divided is energy between the valves and no doubt introduced unwanted friction into the arrangement.

Preferably, the valves are symmetrically arranged to either side of a line of action of the resetting element. This produces a balanced arrangement and avoids sideways loading of the water-detecting/triggering means.

In accordance with a second aspect of the invention, there is provided a bathtub having a bath tap, an overflow hole and an overflow device of the first aspect of the invention, the overflow inlet being mounted in the overflow hole and the water outlet being connected to the bath tap.

Preferably, the bulk of the device is disposed outside the bathtub. For example, in a specific embodiment, all of the device is disposed outside the bathtub except the end of the overflow inlet, a nut, the end of the resetting element, a rose and a mounting plate for the rose.

DETAILED DESCRIPTION OF THE PREFERRED EMBODIMENT

Figure 1:
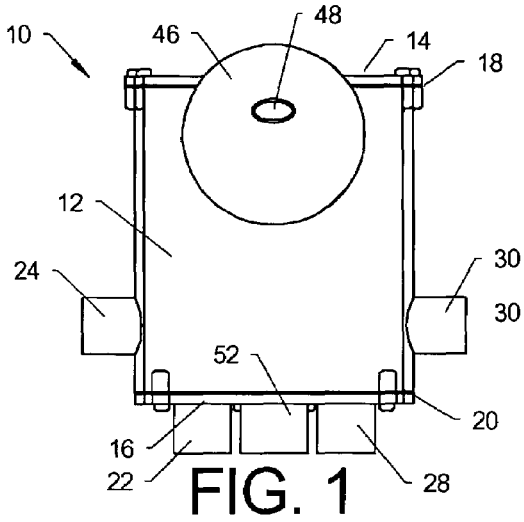
FIGS. 1 to 5 are a front view, rear view, plan view, underplan view and side view, respectively, of an overflow device.
Figure 2:
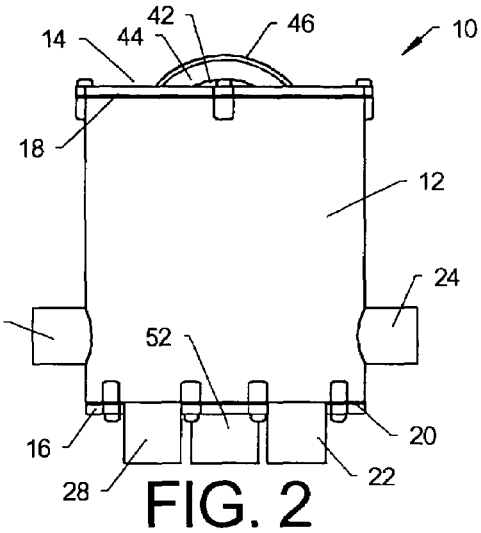
Figure 3:
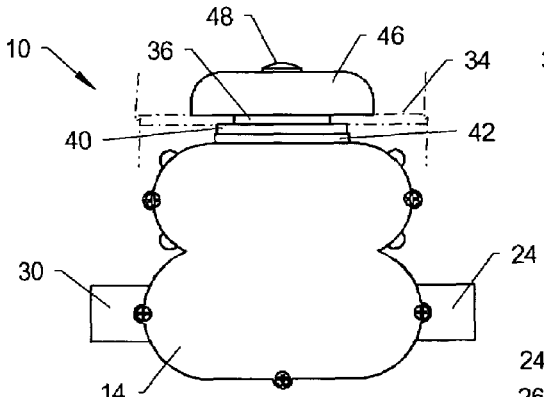
Figure 4:
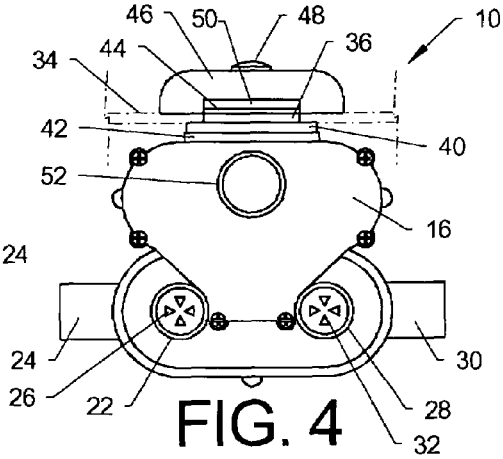
Figure 5:
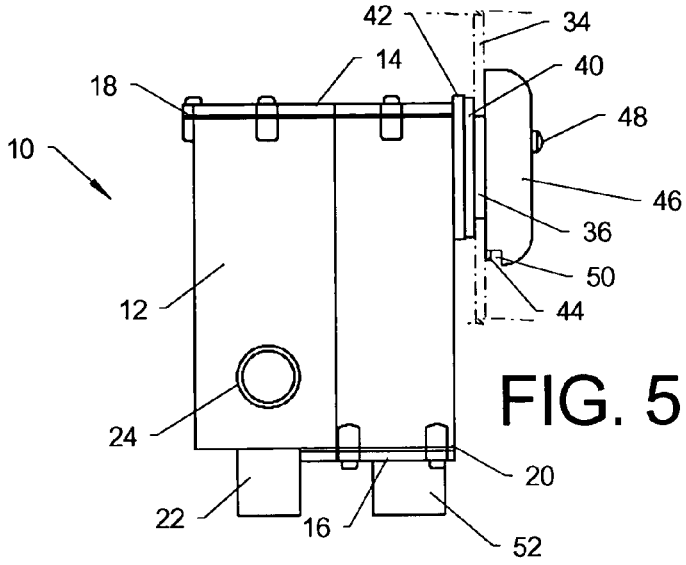
Figure 6:
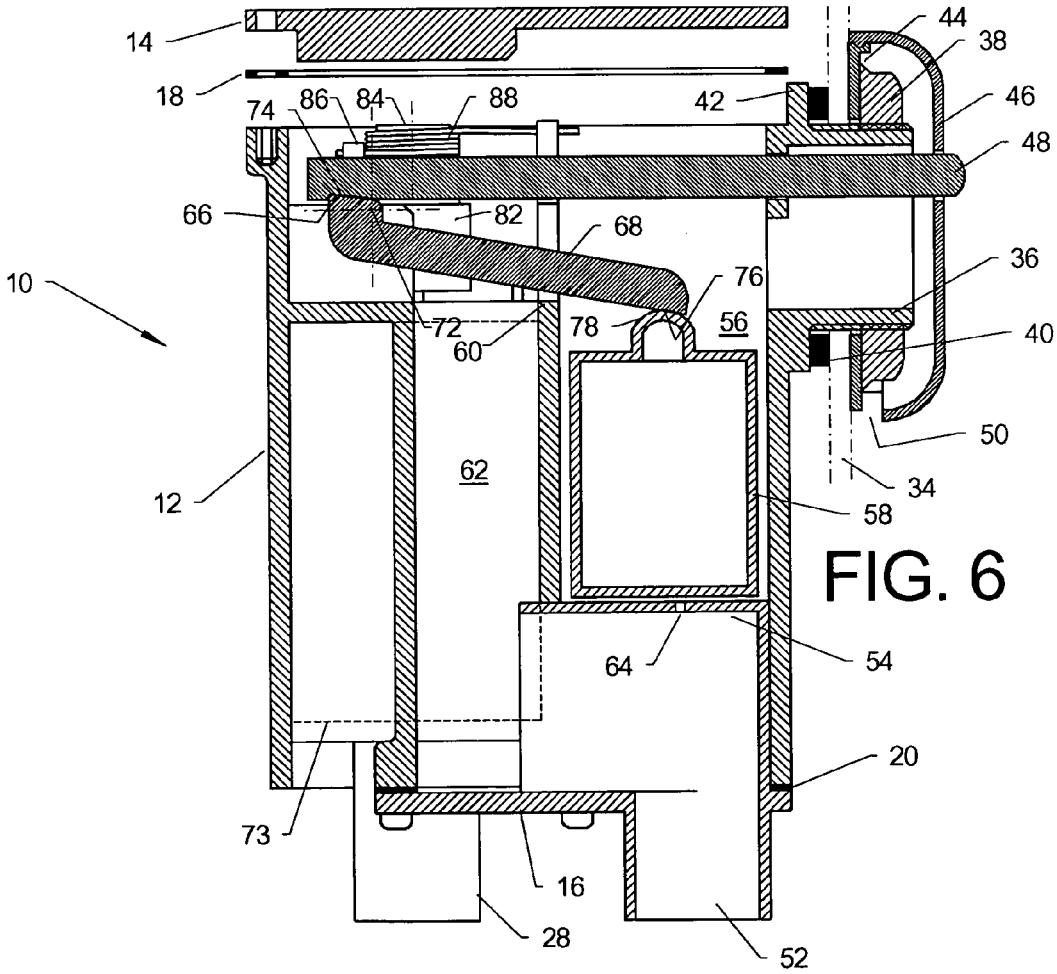
FIG. 6 is a cross-sectioned side view, on a larger scale, of the device, with its top cover removed, in its set state.

Referring to the drawings and in particular to FIGS. 1 to 5, the overflow device 10 comprises a housing 12 having top and bottom covers 14,16 with associated gaskets 18,20 and attached to the housing 12 by screws. The housing 12 and covers 14,16 are moulded in plastics material. The housing 12 provides a cold water inlet 22 and cold water outlet 24 which communicate with each other via a cold water valve 26. The housing 12 also provides a hot water inlet 28 and hot water outlet 30 which communicate with each other via a hot water valve 32. In use, the inlets 22,28 are connected to the domestic cold and hot water supplies, and the outlets 24,30 are connected to conventional cold and hot taps of a bathtub 34 or to a conventional bath mixer tap. The valves 26,32 are ceramic disc valves each having an operating spindle that can be rotated by about a quarter of a turn to turn the valve 26,32 on or off. Referring also to FIG. 6, the housing 12 also provides an overflow inlet 36 that in use passes through a conventional overflow hole in the wall of the bathtub 34 and is held in place by a nut 38. A sealing washer 40 is sandwiched between the wall of the bathtub 34 and a boss 42 formed on the front wall of the housing 12. A rose fixing plate 44 is sandwiched between the wall of the bathtub 34 and the nut 38. A rose 46 is a snap-fit on the rose fixing plate 44, and the end of a reset plunger 48 protrudes through a hole in the rose 46. The underside of the rose 46 has a cut-away 50 so that, when the water in the bathtub 34 reaches a sufficient level, it can flow through the cut-away 50 into the rose 46 and thence into the overflow inlet 36. The bottom cover 16 provides an overflow outlet 52 that in use is connected to a conventional waste pipe leading from the bathtub 34.

Figure 7:
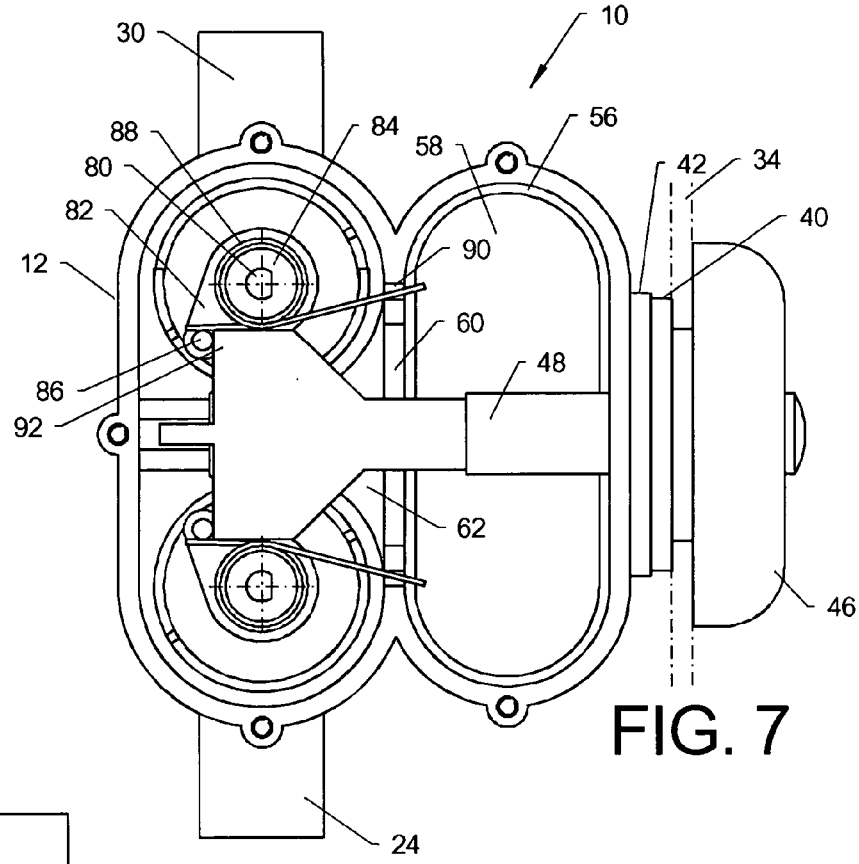
FIG. 7 is a plan view of the device, with its top cover omitted, in the set state.

Referring now in particular to FIGS. 6 and 7, the housing 12 and a portion 54 of the bottom cover 16 together provide a float chamber 56 containing a float 58 and which can fill with bath water entering the device 10 through the overflow inlet 36. The housing 12 also provides a weir 60 over which water can flow from the float chamber 56 to a passageway 62 leading to the overflow outlet 52. A fine drain hole 64 is formed in the portion 54 of the bottom cover 16 providing the base of the float chamber 56 so that, in time, water can escape from the float chamber 56 into the overflow outlet 52 without needing to pass over the weir 60.

The reset plunger 48 extends from the rose 46 almost as far as the rear of the housing 12 and is formed with a notch 66 in its underside adjacent the rear end of the plunger 48. A trigger lever 68 with integral trunnions 70 is supported by the housing 12 for pivoting about the horizontal axis 72 of the trunnions 70. To the rear of the axis 72, the trigger lever 68 provides a pawl 74 releasably engageable with the notch 66 in the reset plunger 48 to provide a detent. To the front of the axis 72, the trigger lever 68 provides a surface 76 against which a protrusion 78 on the top of the float 58 can bear. The distance between the surface 76 and the axis 72 is substantially greater than the distance between the pawl 74 and the axis 72 so that as the surface 76 moves upwardly a particular distance, the pawl 74 moves downwardly by a substantially smaller distance so as to give a velocity ratio of greater than unity from the float 58 to the pawl 74.

Below and symmetrically to either side of the rear end of the trigger lever 68, the housing 12 provides a pair of compartments (shown by dotted lines 73 in FIG. 6) each containing a respective one of the valves 26,32. The operating spindles 80 of the valves 32 project upwardly from the compartments. Each spindle 80 is fitted with a crank 82 having a central boss 84 and an eccentric crank pin 86. A torsion spring 88 is wound around each boss 84 and has one arm engaging the respective crank pin 86 and the other end engaged in a notch 90 in the housing 12 to the side of the weir 60. The springs 88 are arranged to urge the spindles 80 in the directions to close the valves 26,32 and are sufficiently strong to do so even if the valves 26,32 are furred up to some extent. The reset plunger 48 is provided adjacent its rear end with a pair of laterally-projecting, rearwardly-facing abutments 92 that engage the crank pins 86 so that when the reset plunger 48 is pressed inwardly the abutments 92 urge the crank pins 86 in a direction to open the valves 26,32. The underside of the top cover 14 is formed with a portion 94 that projects downwardly into sliding engagement with the rear end of the plunger 48 between the abutments 92, to prevent the rear end of the plunger 48 lifting upwardly so that the pawl 74 will not engage properly with the notch 66.

Figure 9:
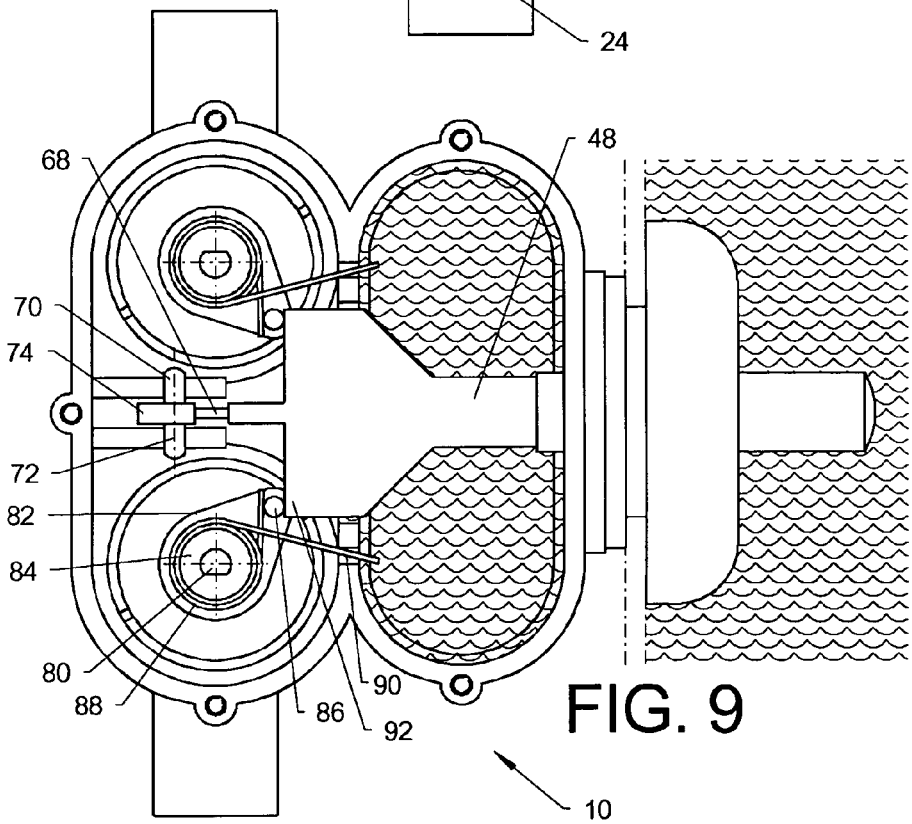
FIGS. 8 & 9 are similar to FIGS. 6 and 7, respectively, but with the device in its triggered state.
Figure 8:
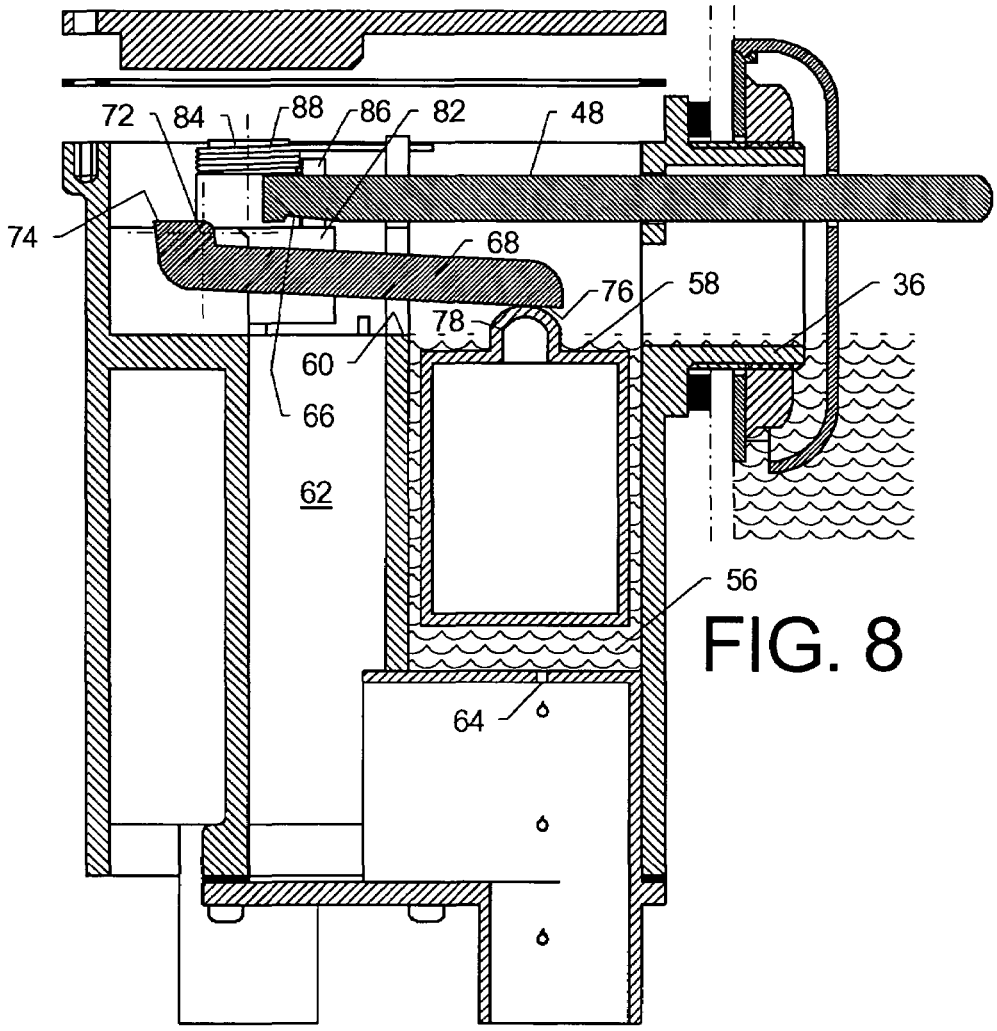

The plumbing device 10 is normally maintained in the "set" state shown in FIGS. 6 and 7. In the set state, the cold and hot water valves 26,32 are open. Therefore, when a user wishes to run a bath, they can open the conventional hot and/or cold taps, and the bathtub 34 will fill with water flowing from the hot and/or cold supplies, via the hot and/or cold water valves 32,26 and the conventional hot and/or cold taps, into the bathtub 34. If the user does not then turn off the conventional hot and/or cold taps before the bathtub 34 starts to overflow, the device 10 is triggered to the "triggered" state shown in FIGS. 8 and 9 in which the hot and cold water valves 32,26 are closed so that filling of the bathtub 34 ceases even though the conventional hot and/or cold taps are still open. More specifically, as the water in the bathtub 34 rises to the level of the overflow inlet 36, it starts to flow through the cut-away 50 in the rose 46 and through the overflow inlet 36 into the float chamber 56, so that the float 58 rises. Gravity tends to hold the trigger lever 68 down on the float 58, but as water level in the float chamber 56 rises and the buoyancy of the float 58 increases, it eventually overcomes the weight of the trigger lever 68 and the friction between the pawl 74 on the trigger lever 68 and the notch 66 in the reset plunger 48, so that the trigger lever 68 pivots anticlockwise as viewed in FIG. 6 and the pawl 74 disengages from the notch 66. The reset plunger 48 is then free to slide to the right as viewed in FIG. 6. Therefore the actions of the springs 88 on the crank pins 86 cause the cranks 82 to turn so that the cold and hot water valves 26,32 close, and the crank pins 86 bearing on the abutments 92 cause the reset plunger 48 to move to the right. The device 10 therefore attains the triggered state of FIGS. 8 and 9.

Once the user gets into the bathtub 34, the water level will rise above the level of the weir 60, so that the weir 60 overflows and the water can pass via the passageway 62 and the overflow outlet 52 to waste. Once such overflowing ceases, the float chamber 56 can gradually empty of water by leakage through the drain hole 64, as a result of which the float 58 falls to the bottom of the float chamber 56 and the trigger lever 68 pivots clockwise, due to gravity, maintaining its surface 76 in contact with the protrusion 78 on top of the float 58. The device 10 is then in a "resettable" state.

Once in the resettable state, for example when the user has finished their bath, or when a user is ready to run another bath, the user can reset the device 10 to its set state by depressing the end of the reset plunger 48 that projects through the rose 46. The plunger 48 will therefore slide to the left as viewed in FIGS. 8 and 9. The abutments 92 on the plunger 48 bearing on the crank pins 86 will turn the cranks 82 so that the cold and hot water valves 26,32 open. The end of plunger 48 will ride over the pawl 74 on the trigger lever 68, slightly tipping the lever 68 anticlockwise, until the notch 66 in the plunger 48 reaches the pawl 74, whereupon the lever 68 will tip back and the pawl 74 will engage the notch 66, so that the device is reset to the set state. If the user has not turned off the conventional bath taps before resetting the device 10, that will be immediately apparent as the cold and hot water valves 26,32 open, thus prompting the user to turn off the conventional bath taps, unless of course they are running another bath.

Various modifications and developments may be made to the embodiment described above. For example, since the end, overflow-providing wall of a typical bathtub is inclined to the vertical by a few degrees, the overflow inlet 36 may be modified so that its axis, and so that the face of its boss 42, are inclined correspondingly. Also, the arrangement of the abutments 92 on the reset plunger 48 may be modified so that the reset plunger 48 cannot be moved to the right, as viewed in FIG. 7, free of the pins 86. For example, the reset plunger 48 may be provided with lateral slots in which the pins 86 are engaged.

It should be noted that the embodiment of the invention has been described above purely by way of example and that many modifications and developments may be made thereto within the scope of the present invention.

What is claimed is:

1. An overflow device for a bathtub having a bath tap and an overflow hole, the device having:

an overflow inlet arranged for mounting in the overflow hole;

an overflow outlet communicating with the overflow inlet and for connection to a waste;

a water inlet for connection to a water supply;

a water outlet for connection to the bath tap;

a valve connected between the water inlet and water outlet and having a closed state and an open state;

means for storing energy that can be used to change the valve from the open state to the closed state;

means for detecting water that has entered the overflow inlet and for triggering the device to change, using energy stored by the energy storing means, from a set state in which the valve is open to a triggered state in which the valve is closed; and a manually operable resetting element that can be operated by a user to replenish the energy storing means with energy and to return the device to the set state;

wherein the device has a second such water inlet for connection to a water supply, a second such water outlet for connection to the, or another, bath tap and a second such valve connected between the second water inlet and second water outlet and having a closed state and an open state, and wherein the water-detecting and triggering means, enemy storing means and resetting means are arranged also to operate the second valve.

2. An overflow device as claimed in claim 1, wherein the resetting element has a portion that projects, or is accessible, through the overflow inlet.

3. An overflow device as claimed in claim 1, wherein the water-detecting and triggering means comprises a float, and a lever acting between the float and a detent arrangement for holding the resetting element in the set state, the lever having a velocity ratio of greater than unity.

4. An overflow device as claimed in claim 1, wherein the energy storing means comprises a respective spring for each valve.

5. An overflow device as claimed in claim 1, wherein the resetting element has a line of action and the valves are symmetrically arranged to either side of the line of action.

6. A bathtub having a bath tap, an overflow hole and an overflow device, the overflow the device having:

an overflow inlet mounted in the overflow hole;

an overflow outlet communicating with the overflow inlet and for connection to a waste;

a water inlet for connection to a water supply;

a water outlet connected to the bath tap;

a valve connected between the water inlet and water outlet and having a closed state and an open state;

means for storing energy that can be used to change the valve from the open state to the closed state;

means for detecting water that has entered the overflow inlet and for triggering the device to change, using energy stored by the energy storing means, from a set state in which the valve is open to a triggered state in which the valve is closed; and a manually operable resetting element that can be operated by a user to replenish the energy storing means with energy and to return the device to the set state;

wherein the device has a second such water inlet for connection to a water supply, a second such water outlet for connection to the, or another, bath tap and a second such valve connected between the second water inlet and second water outlet and having a closed state and an open state, and wherein the water-detecting and triggering means, energy storing means and resetting means are arranged also to operate the second valve.

7. A bathtub as claimed in claim 6, wherein the bulk of the device is disposed outside the bathtub.

* * * * *